US009498661B2

(12) United States Patent
Dall'Agnol et al.

(10) Patent No.: US 9,498,661 B2
(45) Date of Patent: Nov. 22, 2016

(54) FIRE PROTECTION DEVICE FOR ELECTRICAL EQUIPMENTS

(71) Applicant: Everet Duklair S.R.L., Levico Terme (TN) (IT)

(72) Inventors: Guido Dall'Agnol, Marostica (VI) (IT); Daniele Bonotto, Molvena (VI) (IT); Stefano Bonotto, Marostica (VI) (IT)

(73) Assignee: EVERAT DUKLAIR S.R.L., Levico Terme (TN) (IT)

( * ) Notice: Subject to any disclaimer, the term of this patent is extended or adjusted under 35 U.S.C. 154(b) by 0 days.

(21) Appl. No.: 14/901,463

(22) PCT Filed: Jun. 27, 2013

(86) PCT No.: PCT/IT2013/000177

§ 371 (c)(1),
(2) Date: Dec. 28, 2015

(87) PCT Pub. No.: WO2014/207772

PCT Pub. Date: Dec. 31, 2014

(65) Prior Publication Data

US 2016/0166864 A1 Jun. 16, 2016

(51) Int. Cl.

| | |
|---|---|
| ***A62C 8/00*** | (2006.01) |
| ***A62C 3/16*** | (2006.01) |
| ***A62C 8/06*** | (2006.01) |
| ***A62C 3/00*** | (2006.01) |
| ***A62C 2/06*** | (2006.01) |
| ***A62C 99/00*** | (2010.01) |

(52) U.S. Cl.
CPC . *A62C 3/16* (2013.01); *A62C 2/06* (2013.01); *A62C 2/065* (2013.01); *A62C 3/00* (2013.01); *A62C 8/06* (2013.01); *A62C 99/0018* (2013.01)

(58) Field of Classification Search
CPC .... A62C 3/16; A62C 2/065; A62C 99/0018; A62C 8/06; A62C 2/06; A62C 3/00
USPC ..... 169/48, 49, 54, 56, 70; 428/920, 921; 106/18.11
See application file for complete search history.

(56) References Cited

U.S. PATENT DOCUMENTS

| | | | | |
|---|---|---|---|---|
| 3,849,178 A | | 11/1974 | Feldman | |
| 4,467,577 A | | 8/1984 | Licht | |
| 4,597,450 A | | 7/1986 | Budmiger | |
| 5,402,852 A | * | 4/1995 | Alhamad | A62C 3/06 169/49 |
| 6,105,676 A | * | 8/2000 | Alhamad | A62C 3/06 169/49 |
| 2002/0139554 A1 | | 10/2002 | Kubota | |

FOREIGN PATENT DOCUMENTS

| | | |
|---|---|---|
| EP | 0878990 A1 | 11/1998 |
| FR | 2409618 A1 | 6/1979 |
| FR | 2881054 A1 | 7/2006 |
| GB | 2325728 A | 12/1998 |
| GB | 2471929 A | 1/2011 |

OTHER PUBLICATIONS

Notification of Transmittal of the International Search Report and the Written Opinion of the International Searching Authority dated May 21, 2014.
Italian Patent Office Search Report and Written Opinion dated Nov. 13, 2012 (partially in English).

* cited by examiner

*Primary Examiner* — Steven J Ganey
(74) *Attorney, Agent, or Firm* — Hedman & Costigan, P.C.; James V. Costigan; Kathleen A. Costigan

(57) ABSTRACT

A fire protection device for electrical equipments, which is positioned or mounted near the electrical equipment or wrapped around said electrical equipment, comprising a laminar sheet or structure made of a fire-retardant and foaming material, which has a plurality of openings or holes, capable to allow ventilation of the electrical equipments to which the device is applied, said openings or holes being able to close as the temperature increases.

8 Claims, No Drawings

FIRE PROTECTION DEVICE FOR ELECTRICAL EQUIPMENTS

The present invention relates to the field of safety devices and, in particular, relates to a fire protection device for electrical equipments.

In particular, the fire protection device of the present invention can be applied to the bodies of electric motors, to components and electronic circuits and/or to equipments having electrical heaters which can cause fires in the switchboards.

The flammability of plastic structures of the above mentioned electrical equipments is typically established by means of tests whose specifications are outlined by the US company Underwriters Laboratories. In particular, according to said tests, it is necessary to verify either that the plastic material is added with flame retardant or that said plastic material is halogen free.

For example, the test UL 94 HB (Horizontal Burning) determines the flammability of a polymer and consists of measuring the time in which a plastic test sample having a specified thickness and mounted horizontally continues to burn after being hit by the flame of a Bunsen burner for 30 seconds.

According to the test UL 94 HB, the material is classified HB when a specimen having a thickness of 3 mm burns at a maximum speed of 76 mm/minute.

On the other hand, the test called V.0, V.1, V.2 (Vertical Burning) determines the self-extinguishing degree of the material and consists in measuring the time in which the plastic test sample of a specified thickness (3-6 mm), mounted vertically, continues to burn after being hit by the flame of a Bunsen burner for 10 seconds.

According to the UL 94 test, the material is classified V.0 when the flame is extinguished within 10 seconds, while the material is classified V.1 when the flame is extinguished within 30 seconds without drip and is classified V.2 when the flame extinguishes within 30 seconds with dripping.

However, the above mentioned international regulations require the use of flame retardant additives, which should also be used in electrical equipments of common use, such as coffee machines and household appliances in general.

A known technical solution for securing electrical appliances, such as printed circuits, power supplies, reactors, transformers, etc., is to provide a plastic wrapping including flame-retardant polymers which covers said appliances.

The use of flame-retardant polymers however generates high costs because of the considerable cost of the raw material, which determine in their turn a substantial increase of the production costs of the finished product.

Moreover, the composition of said polymers is not suitable for molding operations, thus making said polymers more difficult to produce, and, finally, it is not possible to reuse the waste of the processing of said polymers, which are therefore sold with difficulty.

Furthermore, obtaining certifications required entails additional costs.

Other known solutions adopt flame-retardant chemical elements, which, however, only delay the propagation of a flame, but they are not able to stop it.

Therefore, if the electrical equipment is placed in an unattended environment, the fire may spread unhindered. Inerting gas which are able to stop the oxidation reactions occurring during combustion are also known, but they also have some serious drawbacks, including the fact that said gases are not compatible with the human presence in the same environment, since they greatly reduce the percentage of oxygen in the environment (which is essential for the propagation of flames, but which is, first of all, vital to humans).

A fire protection device for electrical equipments having the technical features of the preamble of the appended claim 1 is known for example from GB2325728A. Therefore, the main object of the present invention is to overcome the drawbacks of the prior art and, in particular, to provide a fire protection device for electrical equipments which is safe and efficient.

Another object of the invention is to provide a fire protection device for electrical equipments which does not require flame-retardant additives.

Another object of the present invention is to provide a fire protection device for electrical equipments which has a low production cost, with respect to known devices.

A further object of the invention is to provide a fire protection device for electrical equipments, the casing of which can be manufactured without the need for large investments for making special molds, since it is enough to use the known apparatus for making usual cardboard boxes.

These and other objects which will be more clear in the following description are obtained by means of a fire protection device for electrical equipments according to the appended claim 1.

Other detailed technical specifications are also given in the dependent claims.

Advantageously, according to preferred embodiments of the invention, the fire protection device of the present invention can be made in at least two variants. According to a first embodiment, a laminar flat and/or with ribs structure, which is made with plastic material, is provided as a mechanical compounded support having thermosensitive chemical elements, which are capable of releasing inerting gases when a predetermined value of temperature is reached.

Alternatively, it is possible to use a lattice-type permeable structure, possibly with filaments and impregnated with the above mentioned substances.

The above predetermined value of temperature is next to a value of temperature that can be generated by a short circuit occurring in the electrical equipments to which the fire protection device is applied.

A further advantage of the invention is that openings or holes and/or ribs (according to the first embodiment) or patterns (according to the second embodiment) with a mesh sufficiently large to allow the air passage are made in the structure.

Therefore, the structure can be easily roll around electrical equipments of small size and also allows efficient heat exchange of said equipments with the outside.

A further advantage of the invention is that the permeable lattice-type structure is made by extruding a plastic material, such as PVC, or a generic shape memory material.

This allows to make the measurements and the desired shape directly from a standard type extruded or laminated structure and with the same apparatus used in the paper industry, thus allowing a high production even for small batches.

Moreover, the activation creates an endothermic reaction which is able to cool the fire generating elements.

The device may further include a dust filter, removable for cleaning, which prevents the clogging of the whole structure due to the dust deriving from the air convective motions; said clogging may cause a possible occlusion of the channels, of the holes or of the aeration lattice-type meshes.

According to a preferred embodiment of the invention, the fire protection device for electrical equipments, which is the object of the present invention, is fixed near the electrical equipments to be protected and is constituted by a sheet or laminar element or by a printed or extruded structure.

The sheet or the structure is made of a substantially fire-retardant material, which is expandable and adaptable in various forms to be folded and positioned around the electrical equipments in order to insulate said equipments from the surrounding environment in the event of fire.

The sheet or the structure has openings or holes and/or ribs or flexible meshes, which are sufficiently large in order to be permeable and allow the passage of air, so as to allow ventilation of the electrical equipments to which it is applied.

According to preferred embodiments of the invention, a sheet or a structure composed of a mixture of expanding graphite, thermosensitive chemical reagents able to release gases for reducing combustion in air and substances having the function of a mechanical support and of bonding between the components, such as silicone, is used.

The sheet or the structure has also a plurality of holes, which are closed when the temperature rises (because the sheet is made with a foaming or expanding material), in order to smother the possible beginning of a fire that may occur in a short time into the electric equipment by removing the combustion element from the air of the environment near the electrical equipment.

As already said, the structure of the device can be advantageously made by extruding or molding a plastomeric or elastomeric plastic material (i.e. a flame-retardant material, such as PVC) or using a fire retardant material or a generic shape memory material, which acts as a compounded mechanical support (such as the expanding graphite bonded with a chemical binder agent and a mechanical support).

Furthermore, the mixture may also be impregnated with thermosensitive chemical substances, able to make an endothermic reaction with release of inerting gases.

Alternatively, it is possible to use filaments impregnated with thermosensitive chemical agents.

In any case, on reaching a prefixed value of temperature, which is evaluated as suitable for preventing a fire, said thermosensitive chemical substance enables a chain reaction and inerting gases, such as for example nitrogen or argon, and steam or gases able to make a oxidation-reduction process are released.

The extinguishing action of the inerting gas reduces the percentage of oxygen below 16% with a consequent inability of combustion to proceed.

Advantageously, the fire is immediately stopped, because an extinguishing chemical action is added to the mechanical action determined by closing the structure's holes and by the subsequent fire's choking, due to the lack of oxygen near the electrical equipment to protect.

Preferably, the device of the invention can be wound around the electric cables, around the bodies of electric motors, around the boilers with electric heaters, inside cable ducts, within electronic circuits or can be placed and/or fixed near the electrical equipments installed in switchboards.

Advantageously, the device of the invention may also be placed very close to the possible source of the flame, so that it is able to act immediately and in any case before the propagation of the flames.

It is thus possible to enclose a very narrow risk area and it is also possible to release a quantity of inerting gas which is lower than that required to extinguish large outbreaks, in order not to endanger the health of persons that may be present in the surroundings.

The device of the present invention, equally advantageously, does not act as a flame retardant, but it stops the fire as soon as the fire starts, thus being an extremely powerful device, since it allows to automatically and promptly take action when the fire starts, thus avoiding the need of extinguishing fire once the same has already flared up.

Moreover, unlike the remote alarm electronic devices, the device of the invention is able to activate and eliminate the danger even when mains supply, telephone connections and/or radio links are not provided.

Additionally, the device of the invention increases safety in electrical installations and reduces the possibility of propagation of the flame generated from the starting of fire.

Furthermore, as above described, the device of the invention acts as a fire retardant element and is also able to generate a gas by exploiting the effects of an endothermic reaction, thus lowering the temperature in the ignition zone, as well as causing the heat exchange towards the outside and consequently the cooling of the electrical equipments.

Finally, in other embodiments of the invention, the device may further comprise a dust filter, which is removable for cleaning it, so that the structure of the device is protected by clogging due to dust.

In particular, according to a preferred embodiment of the invention, the filter is positioned within the structure and upstream the air inlet.

From the foregoing description, the technical features of the fire protection device for electrical equipments, object of the present invention, as well as the related advantages, are rather clear.

Finally, it is clear that other variations may be made to the fire protection device of the invention, without departing from the principles of novelty inherent in the inventive idea of the appended claims, as it is clear that in the practical implementation of the invention the materials, shapes and dimensions of the technical details may be any according to requirements and that they can be replaced with other technically equivalent.

The invention claimed is:

1. Fire protection device for electrical equipments, which is positioned or fixed near the electrical equipment or wrapped around said electrical equipment, comprising a laminar sheet or structure made of a fire-retardant and foaming material, said sheet or structure having a plurality of openings or holes, capable to allow ventilation of the electrical equipments to which the device is applied, said openings or holes being configured to close as the temperature increases, characterized in that said fire-retardant and foaming material is impregnated with thermosensitive chemical agents, which are able to activate the release of inerting gases when a predetermined value of temperature is reached, said predetermined value of temperature being close to the value of temperature of a flame ignition, which is generated by a fault in said electrical equipments.

2. Fire protection device according to claim 1, characterized in that said structure is made by extrusion of a plastic material or of a generic shape memory material or said structure is constituted by a permeable lattice-type structure.

3. Fire protection device according to claim 1, characterized in that at least one adhesive substance is inserted within said fire-retardant and foaming material.

4. Fire protection device according to claim 1, characterized in that said fire-retardant and foaming material includes expanding graphite.

5. Fire protection device according to claim 1, characterized by comprising a dust filter, which can be removed for cleaning it.

6. Fire protection device according to claim 5, characterized in that said dust filter is positioned upstream the air inlet and inside said structure made of fire-retardant and foaming material.

7. Fire protection device according to claim 1, characterized in that said device is able to exploit the effects of an endothermic reaction which lowers the temperature in the ignition area.

8. Fire protection device according to claim 1, characterized in that said structure made of fire-retardant and foaming material is manufactured so that it is possible to make the measurements and the desired shape with the same apparatus used in the paper industry, avoiding huge investments in molds and allowing a high production even for small batches.

* * * * *